US006193146B1

(12) United States Patent
Morrow et al.

(10) Patent No.: US 6,193,146 B1
(45) Date of Patent: Feb. 27, 2001

(54) BEADED-TOP TWIST CAN AND METHOD OF MAKING SAME

(75) Inventors: J. Mark Morrow, Camden; Mickey Braddock; Floyd Boatwright, both of Hartsville, all of SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/483,053

(22) Filed: Jan. 13, 2000

(51) Int. Cl.[7] ..... B65D 3/22; B65D 3/28

(52) U.S. Cl. ..... 229/4.5; 40/310; 206/459.5; 493/111; 493/152; 493/158

(58) Field of Search ..... 229/4.5, 5.5; 206/459.5; 40/306, 310, 506; 493/111–114, 152, 158, 159, 908

(56) References Cited

U.S. PATENT DOCUMENTS

| | | | | |
|---|---|---|---|---|
| 247,302 | | 9/1881 | Candy . | |
| 250,026 | | 11/1881 | Whitelaw . | |
| 790,281 | * | 5/1905 | Bostwick | 40/310 |
| 1,064,576 | | 6/1913 | Washburn . | |
| 2,091,346 | * | 8/1937 | Wright | 40/310 |
| 2,139,660 | * | 12/1938 | Birkland | 40/306 |
| 2,931,657 | | 4/1960 | Lewis | 273/155 |
| 4,122,790 | | 10/1978 | Rowe et al. | 113/120 |
| 4,196,841 | | 4/1980 | Smith et al. | 229/43 |
| 4,280,653 | | 7/1981 | Elias | 229/43 |
| 4,288,026 | * | 9/1981 | Wilhelm | 229/4.5 |
| 4,445,691 | | 5/1984 | Stark et al. | 273/155 |
| 5,007,578 | * | 4/1991 | Simone | 206/459.5 |
| 5,431,619 | | 7/1995 | Bacon et al. | 493/158 |
| 5,884,421 | | 3/1999 | Key | 40/306 |
| 5,953,170 | * | 9/1999 | Glancy | 40/310 |

* cited by examiner

*Primary Examiner*—Gary E. Elkins
(74) *Attorney, Agent, or Firm*—Seidel, Gonda, Lavorgna & Monaco, PC

(57) ABSTRACT

A beaded-top twist container is provided with an inner layer and an outer layer, the outer layer being concentric with the inner layer. The inner layer is joined to the outer layer at the top and bottom edges by a bead. At least one rotatable segment is formed from the outer layer by separating the outer layer into at least three segments, the separations being formed by scoring through the outer layer without destroying the integrity of the inner layer. At least one rotatable segment is formed adjacent to a top or bottom bead by forming a separation adjacent the bead between the inner and outer layers.

21 Claims, 11 Drawing Sheets

2
31
32
12
34
30
14
10
2
16
18

34
32
4
30
10
4
14
16
18

BEADED-TOP TWIST CAN AND METHOD OF MAKING SAME

FIELD OF THE INVENTION

The present invention pertains to the production of cylindrical containers, and more particularly to the production of cylindrical containers wherein an outer layer of the container is sectioned into segments which can rotate about the container, such that images or other indicia on one segment can be twisted relative to images on a neighboring segment to create a variety of presentations.

BACKGROUND OF THE INVENTION

In order to create more attractive packaging for various materials, packaging manufacturers have created containers wherein segments of the container can move relative to other portions of the container, allowing images or other graphics on a rotatable segment to be moved relative to graphics on fixed portions, or relative to graphics on other rotatable segments. Simple presentations involve a single rotating segment, which can be mixed and matched against adjacent fixed portions of the outer layer. A more complex presentation involves a fixed portion and two or more rotating segments. Such a presentation can, for example, use a fixed portion to show the lower torso of a cartoon character, with two rotatable segments presenting the upper torso and head. As the number of rings is increased, the potential variations between the images or graphics also increases.

One principle problem in forming rotatable segments has been in retaining the segments on the container. Where the container or rotatable segment is formed by injection molding, raised flanges or other retention devices can be formed on one or the other components to prevent a rotating segment from becoming separated from the container. Examples of such retention devices can be seen, for example, in U.S. Pat. No. 5,884,421. In this patent, flanges or rims are formed to prevent a rotating ring from separating from the container. Also, lips are formed on the outer shell. These flanges have the disadvantage of requiring the fabrication of the retention devices on one member or the other.

Another form of creating a rotatable segment on the exterior of a container involves forming a raised flange by bonding a non-rotating portion of the outer layer to the inner layer. Such a formation can be seen in U.S. Pat. No. 5,884,421. This method has the disadvantage of requiring accurate placement of the bonding agent to keep it from binding rotating segments to the inner layer.

Another method of creating a twist container uses a simple cylindrical tube, often formed of cardboard or a similar inexpensive material. Concentric segments are placed around the outside of the tube, and retained about the tube by joining the topmost and bottom most segments to the inner cylinder. A bead may be used to join the top edges of the inner and outer layers. These containers are called beaded-top twist containers. One disadvantage of this method is that a substantial portion of the outer layer at both the top and bottom remains fixed to the inner layer. Since both the top and bottom are fixed, the graphics or images on the top and bottom portion of the outer layer are fixed relative to each other. This limits the variations which can be presented.

Beaded-top twist containers incorporating rotatable segments are generally cylindrical in shape in the area where a rotatable segment is assembled to the container. As a convention, the cylinder is described as being oriented such that the open ends of the cylinder face up and down, with the long center axis of the cylinder being vertical. A bottom closure is provided to seal the bottom opening of the cylinder, and typically consists of a thin metal plate, the edges of which are crimped around the bottom edge of the cylindrical tube. The top closure can be fabricated in a variety of manners, dependent on the intended use and allowable cost of the container. Typical methods are to form a bead around the edge of the cylindrical tube by outwardly rolling the edge, or to crimp a metallic element to the edge. A closure for the top of the container can then be formed by bonding a membrane to the bead. Alternately, or additionally, a plastic cap can be placed over the bead at the top edge of the container. Yet another alternate top closure incorporates a cap or metal end which is crimped or bonded to the top edge of the cylindrical container, similar to the bottom closure described above. The cap may be scored to allow removal of the center section of the cap using a pull tab.

Rotatable segments can also be formed from the outer layer by cutting the outer layer into segments after the outer layer has been assembled around the inner layer. The separation can be accomplished by a scoring operation, which involves cutting through the outer layer of the container without destroying the integrity of the inner layer. The integrity of the inner layer is destroyed when it is cut through by the scoring operation, or cut through sufficiently to significantly weaken the inner layer. The scoring can be accomplished by running a sharp edge along the path desired to form the separation line between segments. Pressure must be applied to the sharp edge to cause it to cut the outer layer. The scoring operation typically does not remove outer layer material, but rather severs adjacent portions of the material.

The total height of the segments after the outer layer has been segmented is not significantly reduced from the height of the outer layer before the outer layer is segmented. This can cause a mechanical interference between the segments of the outer layer, preventing them from turning relative to other segments or fixed portions of the outer layer. This interference can apply unwanted pressure to the beads incorporated in the top and bottom closures, potentially causing the beads to be damaged. The friction caused by the interference may reduce itself over time, however the initial perception of the twist container is not positive, as it may be difficult to rotate the segments.

SUMMARY OF THE INVENTION

The present invention is a beaded-top twist container and a method for making the beaded-top twist container. The beaded-top twist container comprises a cylindrically shaped inner layer and an outer layer concentric with the inner layer. The outer layer has a slightly greater inner diameter than the outer diameter of the inner layer, allowing the outer layer to twist relative to the inner layer. The top edges of the inner and outer layer may be joined together by a bead joint, as may the bottom edges of the inner and outer layers. Alternately, the top edge of the outer layer is not joined to the inner layer. The outer layer is separated into at least three segments by scores around the scoring through the outer layer around the circumference of the outer layer without destroying the integrity of the inner layer. By removing a segment of the outer layer, a segment of the outer layer immediately adjacent to the top or bottom bead is rotatable around the inner layer.

BRIEF DESCRIPTION OF THE DRAWINGS

For the purpose of illustrating the invention, there is shown in the drawings a form which is presently preferred.

it being understood, however, that this invention is not limited to the precise arrangements and instrumentalities shown.

DETAILED DESCRIPTION OF THE DRAWINGS

Figure 1:
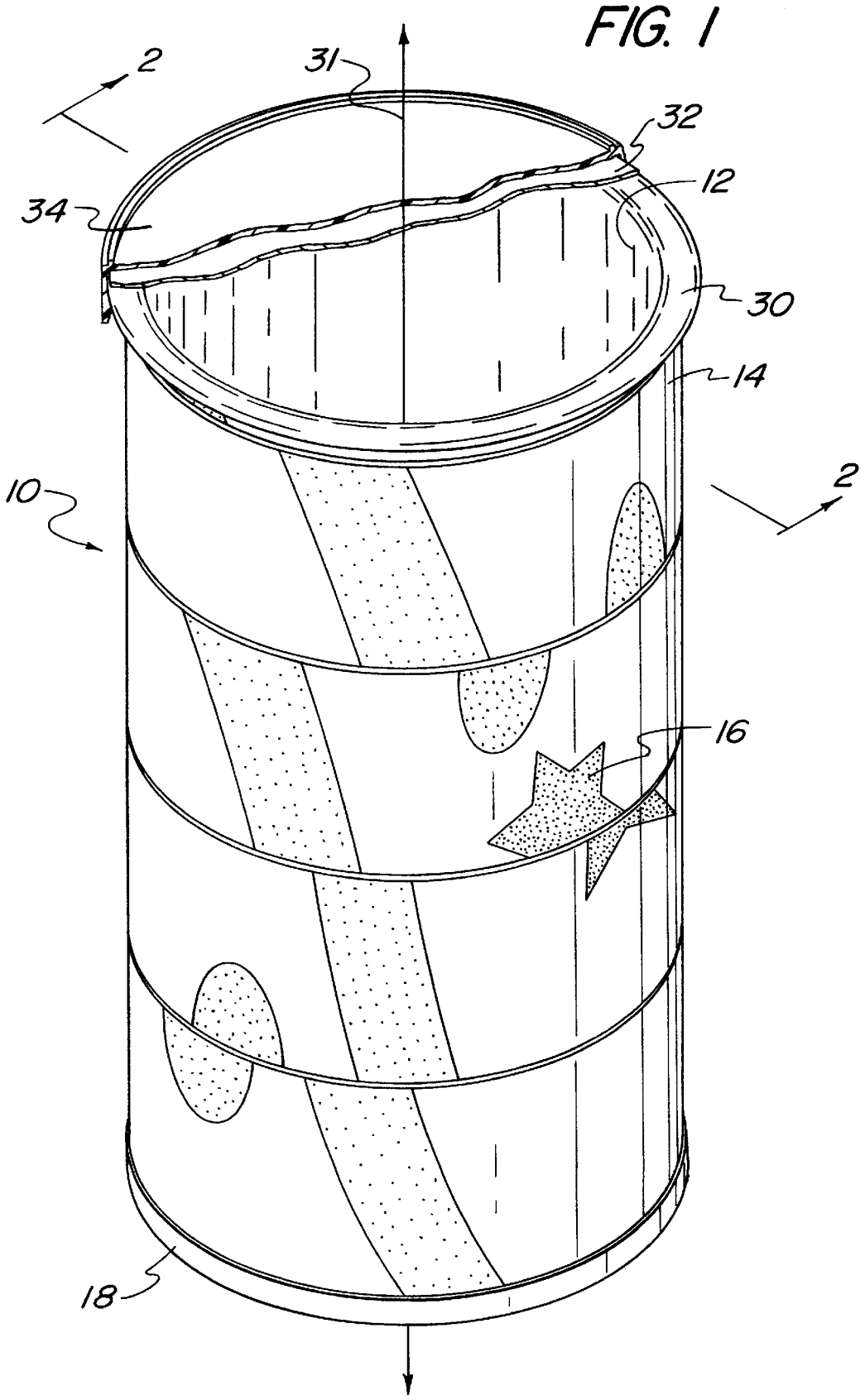
FIG. 1 is a perspective view of a beaded-top twist container displaying indicia on segmented rings as contemplated by the present invention, with a rotatable segment adjacent to the top bead joint.

Referring now to the drawings, wherein like reference numerals illustrate corresponding or similar elements throughout the several views, FIG. 1 shows a beaded-top container 10 comprised of an inner layer 12 formed in a cylindrical shape about a center axis 31. An outer layer 14 is formed concentrically around the inner layer 12. The assembly of the inner layer and the outer layer yields a cylinder having a center axis 31 about which the inner layer 12 and outer layer 14 are concentric. The assembly including the inner layer 12 and the outer layer 14 has an open top and an open bottom. Indicia 16 can be printed on the outer surface of the outer layer 14.

The composition of the inner layer 12 is largely dictated by the nature of the material to be contained within the container and the nature of the bead chosen. The inner layer 12 of the beaded-top twist container 10 may be comprised of several plies, such as a combination of polyethylene film, aluminum foil, and cardboard, as noted in U.S. Pat. No. 3,973,719.

The composition of the outer layer 14 is largely dictated by the requirement of providing a sufficiently tough exterior to protect the inner layer 12, as well as that of providing a suitable surface for the printing of the indicia 16. One generally suitable material is cardboard, however this may be joined with other materials to gain other properties as required.

The inner layer 12 and outer layer 14 may be formed by fabricating a continuous cylinder by spiral wrapping the inner layer 12 around a mandrel (not shown). This method is well known in the art. The outer layer 14 can then be spiral wrapped around the inner layer, without the addition of any bonding agent or adhesive between the layers. This allows the outer layer 14 to rotate relative to the inner layer 12 as required to produce the beaded-top twist container 10. The combination inner layer 12 and outer layer 14 can then be cut to length for the production of the beaded-top twist container 10.

Figure 2:
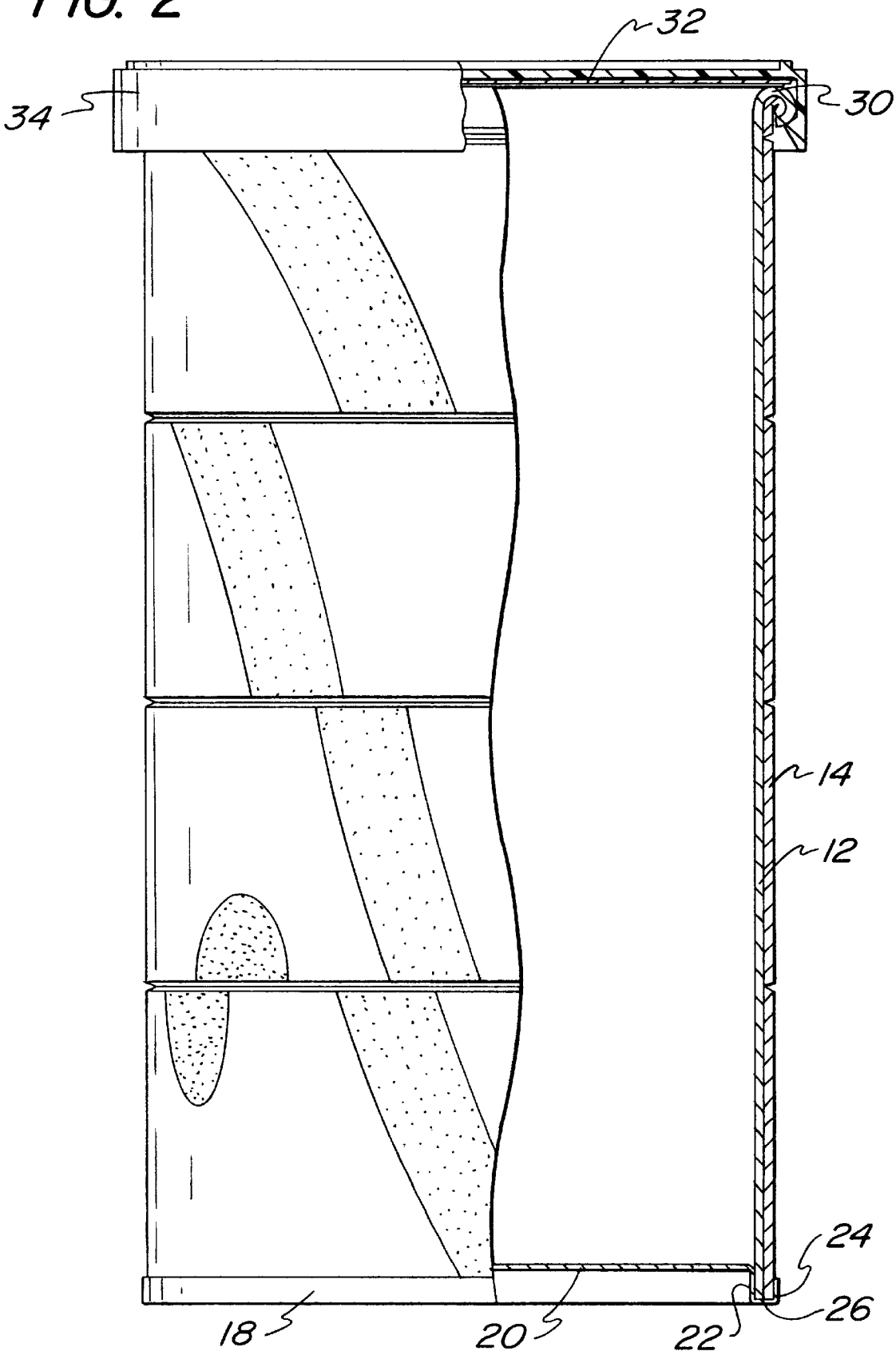
FIG. 2 is a partial cross sectional view of a beaded-top twist container showing a top seal, and a rotatable segment adjacent to the top bead joint.

Referring to FIG. 2, it is shown that a bottom closure 18 generally includes a flat portion 20, inner vertical 22, outer vertical 24, and a connecting leg 26 between the inner vertical 22 and the outer vertical 24. The bottom closure is then attached to the cylinder formed from the inner layer 12 and the outer layer 14 by inserting the structure formed by the inner layer 12 and the outer layer 14 into the annular volume between the inner vertical 22 and the outer vertical 24, until it rests against the connecting leg 26. The outer vertical 24 is then deformed towards the inner vertical 22, clamping the inner layer 12 and outer layer 14 together. This deformation can be created by compressing the inner vertical 22 and the outer vertical 24 towards each other by forcing the inner vertical and outer vertical between rollers.

As shown in FIG. 1, a top closure is also formed onto the cylinder formed by the assembled inner layer 12 and the outer layer 14. This top closure means can be formed by several methods which are generally known. These methods involve the formation of a top bead 30 onto the assembled inner layer 12 and outer layer 14. A membrane 32 may be adhered to the top bead 30, or a flexible cap 34 may be engaged over the top bead, to close the top opening of the beaded-top twist container 10. A variation on the top closure can be created by using a top plate formed similarly to the bottom closure 18 discussed above. The plate incorporates lines of decreased thickness in the top panel, and a pull ring or other handle attached within the lines of decreased thickness to the top plate. Pulling the pull ring or other handle causes the center of the top plate to separate from the bead along the lines of decreased thickness, allowing access to the contents of the beaded-top twist container. The top closure can also employ a combination of these elements, such as a flexible cap 34 over a membrane, as shown in FIG. 2, or the attachment of a flexible cap over a scored top with a pull ring (not shown).

Each of these methods include the formation of some form of a bead at the top edge of the container. The bead serves to protect the edge at the top of the beaded-top twist container by either covering it with a durable material or by rolling at least one layer over, such that the top edges of the inner 12 and outer 14 layers are not exposed.

One formation of this bead can be seen in FIG. 2, showing a rolled top bead 36. Such a rolled top bead 36 is known in the art, having been shown in U.S. Pat. No. 4,196,841. An improved method for forming such a rolled top bead, showing only a single layer wall is shown in U.S. Pat. No. 5,431,619. The rolled top bead 36 of FIG. 2 rolls the top edge of the inner layer 12 and the outer layer 14 outward and then back under against the exterior of the outer layer 14. This bead thus creates a top edge 38 to the container formed by the interior surface of the inner layer material.

An alternate bead, known in the art, can be formed at the opening at the top of the cylinder formed by the inner and outer layers by forming a separate annular shaped top ring, the top ring having an inverted u-shaped cross section formed by an inner leg, an outer leg, and a cross leg. The top ring is placed over the top edge of the cylinder formed by at least the inner layer. The ring can either be adhered to the cylinder through the inclusion of a bonding agent between the top ring and the inner and outer layers, or by crimping the top ring against at least the inner layer.

Figure 3:
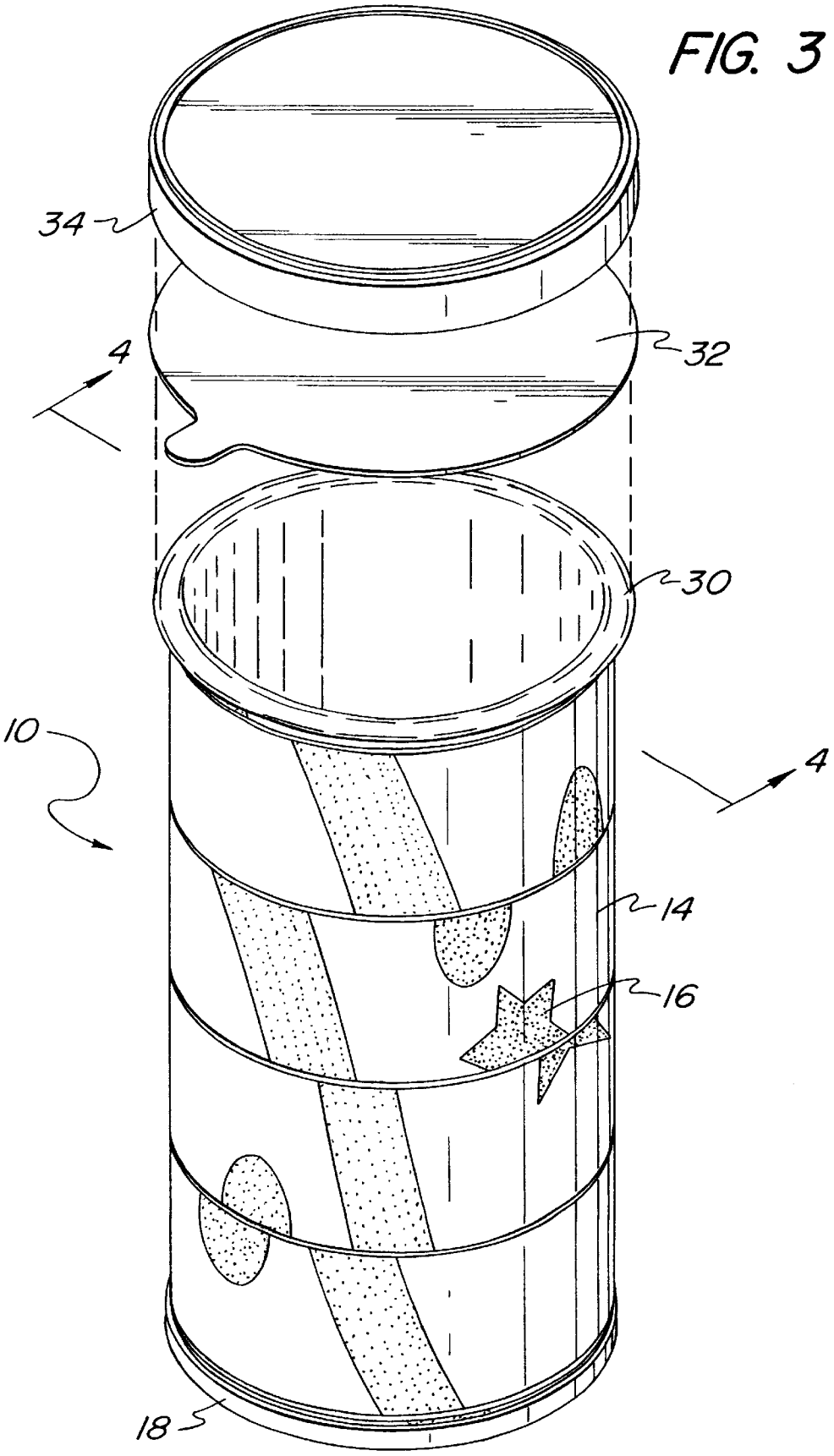
FIG. 3 is a perspective view of a beaded-top twist container displaying indicia on segmented rings as contemplated by the present invention, with rotatable segments adjacent to the top and bottom bead joints.
Figure 4:
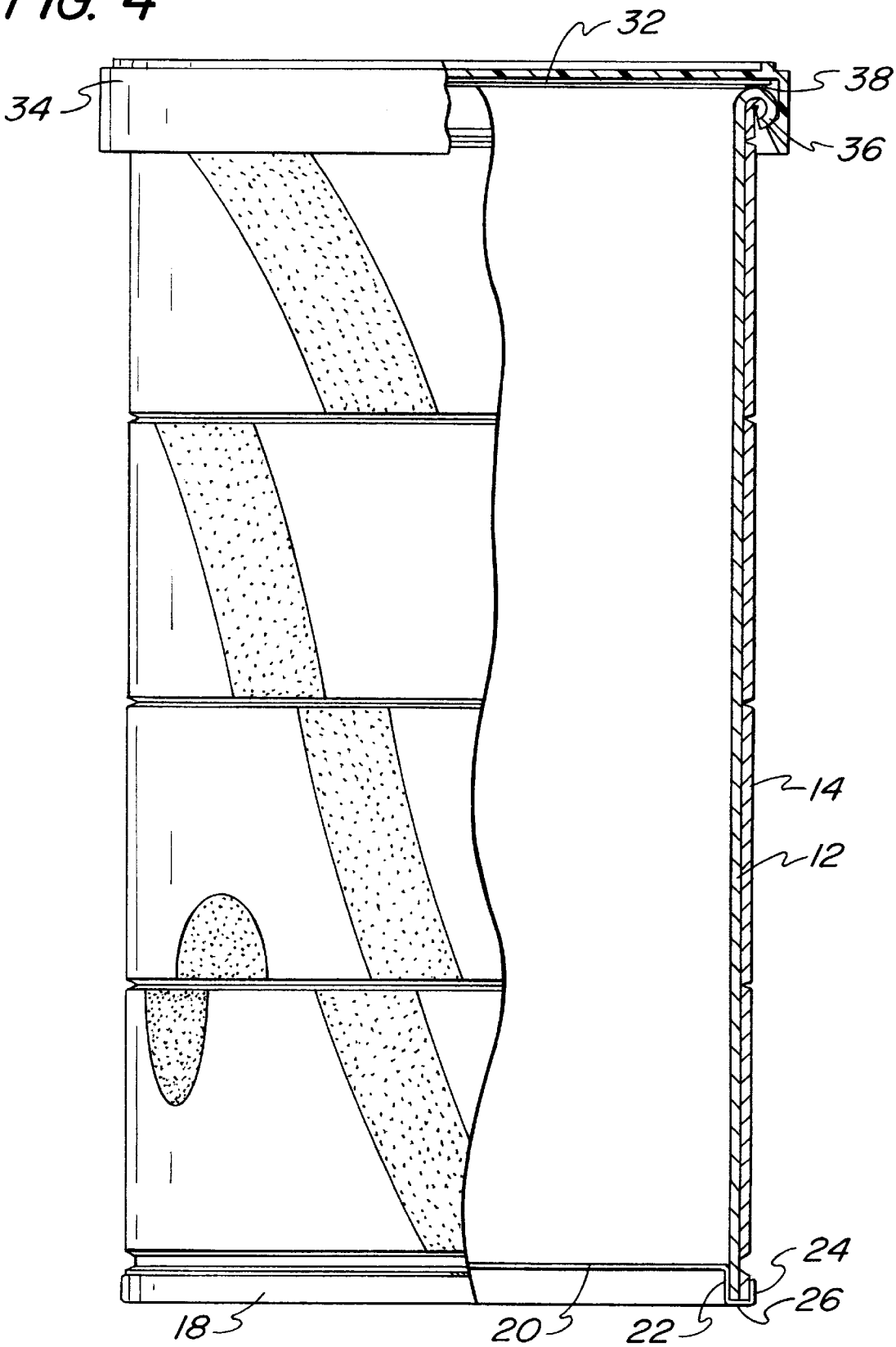
FIG. 4 is a partial cross sectional view of a beaded-top twist container taken along line 4—4 of FIG. 3, showing rotatable segments adjacent to the top and bottom bead joints.

Rotatable segments 15 can be formed by separating segments of the outer layer 14 from the portions of the outer layer 14 which are joined to the inner layer 12 by upper or lower bead joints. FIGS. 1 and 2 show a beaded-top twist container wherein a rotatable segment 15 is formed adjacent to the upper bead 30 by the formation of a clearance ring 30. Each rotatable segment has a top side 33 and a bottom side 35. A fixed segment 17 remains adjacent to the lower bead joint 18 in this illustration. FIGS. 3 and 4 illustrate a beaded-top twist container wherein rotatable segments 15 and 21 are formed adjacent to both the upper bead joint 30 and the lower bead joint 18. A clearance ring 19 adjacent to the lower bead joint 18 separates the bottom rotatable segment 21 from the lower bead joint 18, allowing substantially all of the outer layer 14, except the portions joined within the beads to the inner layer 12, to rotate relative to the bead joints.

Figure 5:
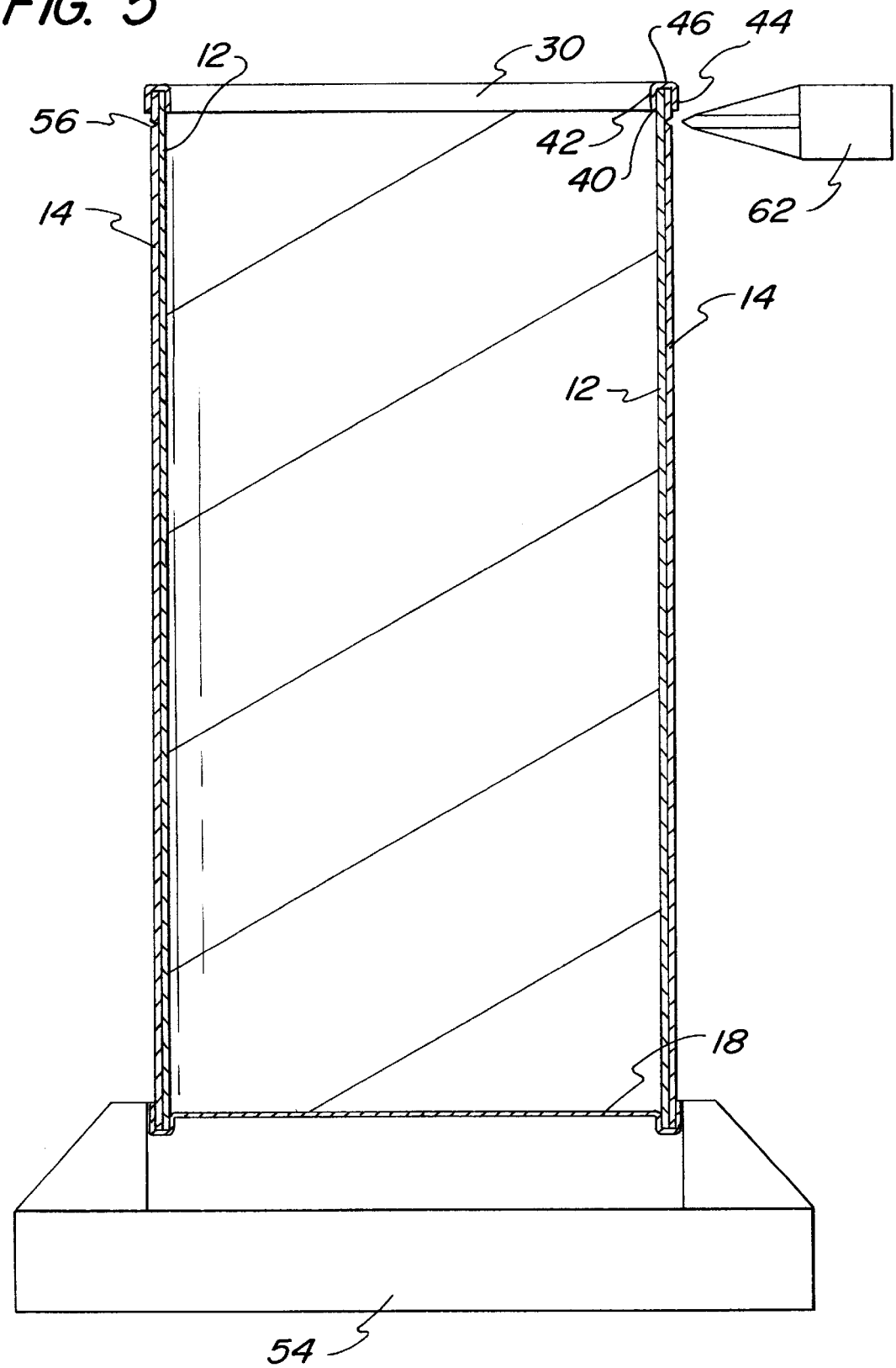
FIG. 5 is a cross sectional view of a beaded-top twist container showing the creation of a first score line through the outer layer.

Once an inner layer and an outer layer have been assembled together, the rotatable rings can be formed. As shown in FIG. 5, the assembly consisting of the inner and outer layers 12 and 14, the top bead 30, and the bottom closure 18 can be fixtured to allow the segments to be formed. The fixture 54 holds the assembly, and prevents it from moving due to the pressure applied by the scoring tool 62.

FIG. 5 illustrates the formation of the first score line 56 on the assembly. The first score line 56 can be formed by pressing a cutting tool against the outer layer 14, and then forcing the cutting tool 62 around the circumference of the assembled inner and outer layers. An alternate method is to hold the cutting tool 62 fixed and rotate the assembly, such that the first score line 56 is also formed around the circumference of the assembly.

Figure 6:
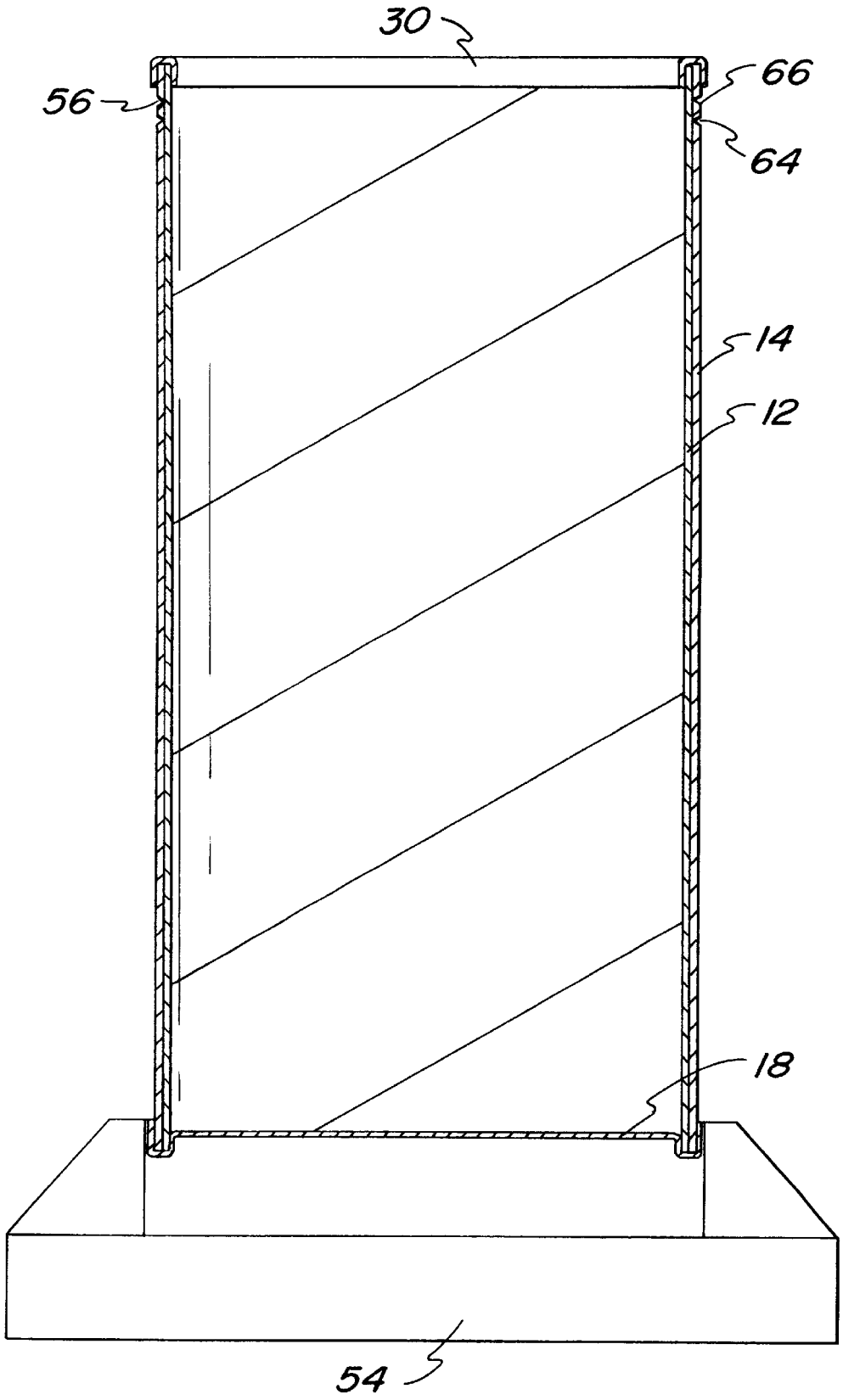
FIG. 6 is a cross sectional view of a beaded-top twist container showing the creation of a second score line to form a clearance ring.

FIG. 6 shows the presence of the second score line 64 which forms a thin segment herein called a clearance ring 66 from the outer layer 14. It is preferred to remove this clearance ring from the assembly, thus providing additional clearance for rotatable segments formed from the outer layer to rotate relative to each other.

Figure 7:
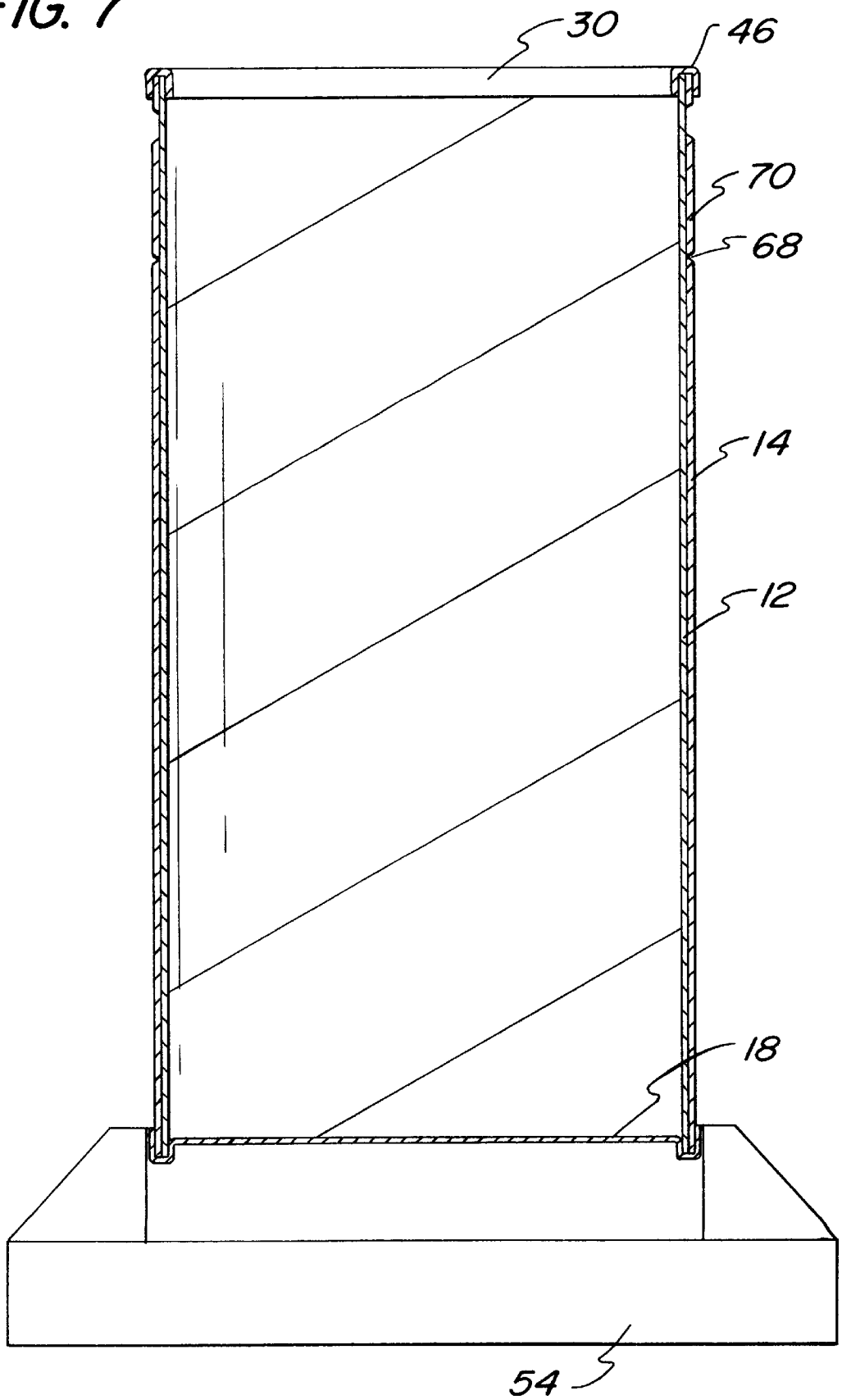
FIG. 7 is a cross-sectional view of a beaded-top twist container showing the creation of a third score line to form a rotatable segment, and with the clearance ring removed.

FIG. 7 shows the formation of a third score line 68 which extends around the circumference of the assembled inner and outer layer. This third score line 68 allows a first rotatable segment 70 to be separated from the outer layer 14. It can also be seen from this illustration that attempts to subdivide the first rotatable ring further by scoring it may be difficult. The connection to the outer layer which prevented the portion of the outer layer being scored form rotating relative to the fixture is now broken.

Figure 8:
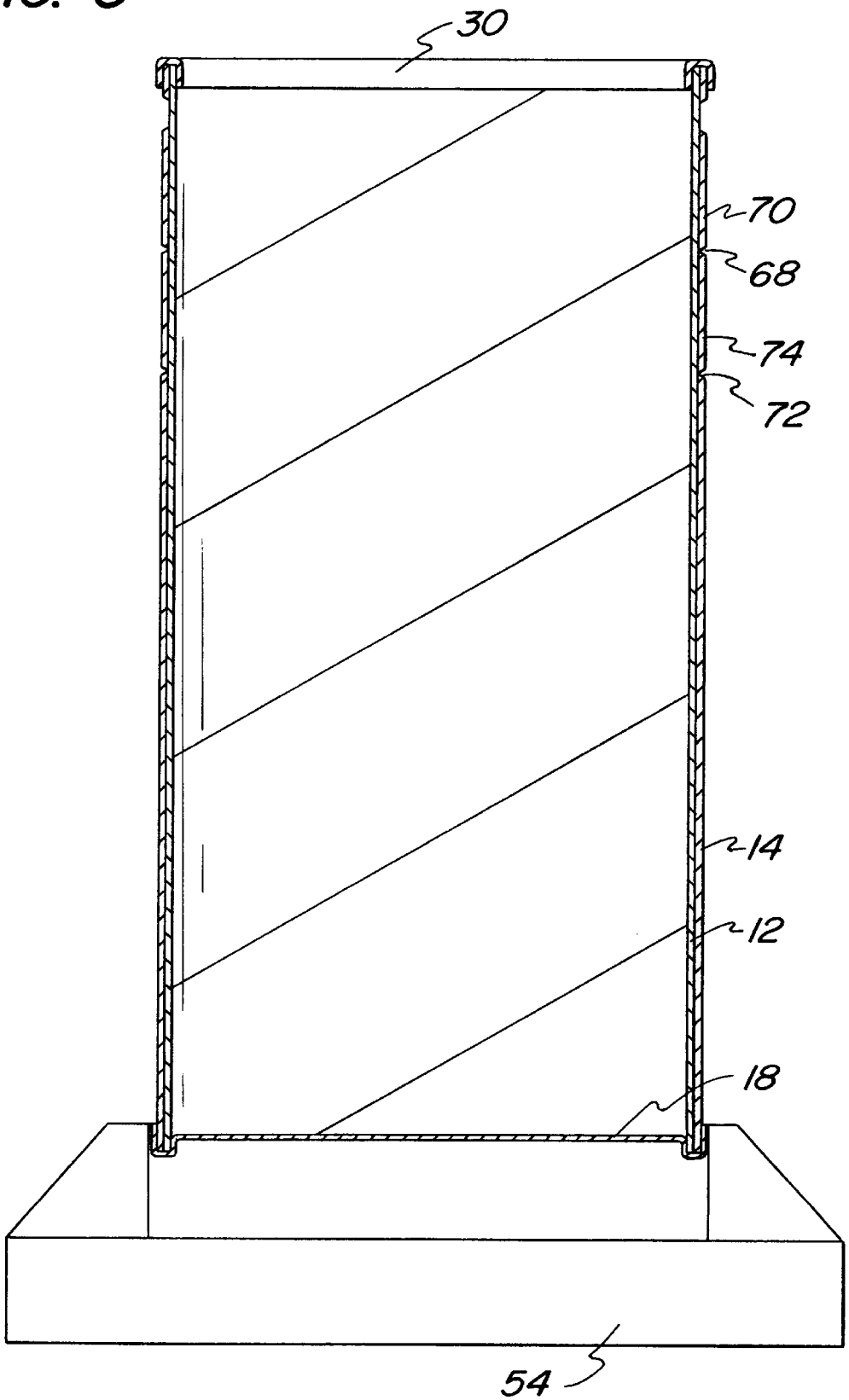
FIG. 8 is a cross sectional view of a beaded-top twist container showing the formation of an additional rotatable segment.

FIG. 8 shows the formation of a fourth score line 72 which separates a second rotatable segment 74 from the outer layer 14. Additional score lines can be formed, creating additional rotatable segments. A final score line may be made adjacent to a bead clamped in the fixture, allowing substantially all of the outer layer 14 to be transformed into rotatable segments.

FIGS. 5–8 illustrate the formation of a rotatable segment adjacent to the top ring. A rotatable segment can be formed adjacent to the bottom ring, as shown in FIGS. 3 and 4, by forming a score line adjacent to the bottom bead joint. If no rotatable segment is to be formed adjacent to the top bead joint, then the clearance ring may be formed and removed adjacent to the bottom bead joint, or between intermediate rotatable segments. If rotatable segments are to be formed adjacent to both the top and bottom bead joints, then a single clearance ring can be formed either adjacent to the top or bottom rotatable segments, or between intermediate rotatable segments.

Figure 9:
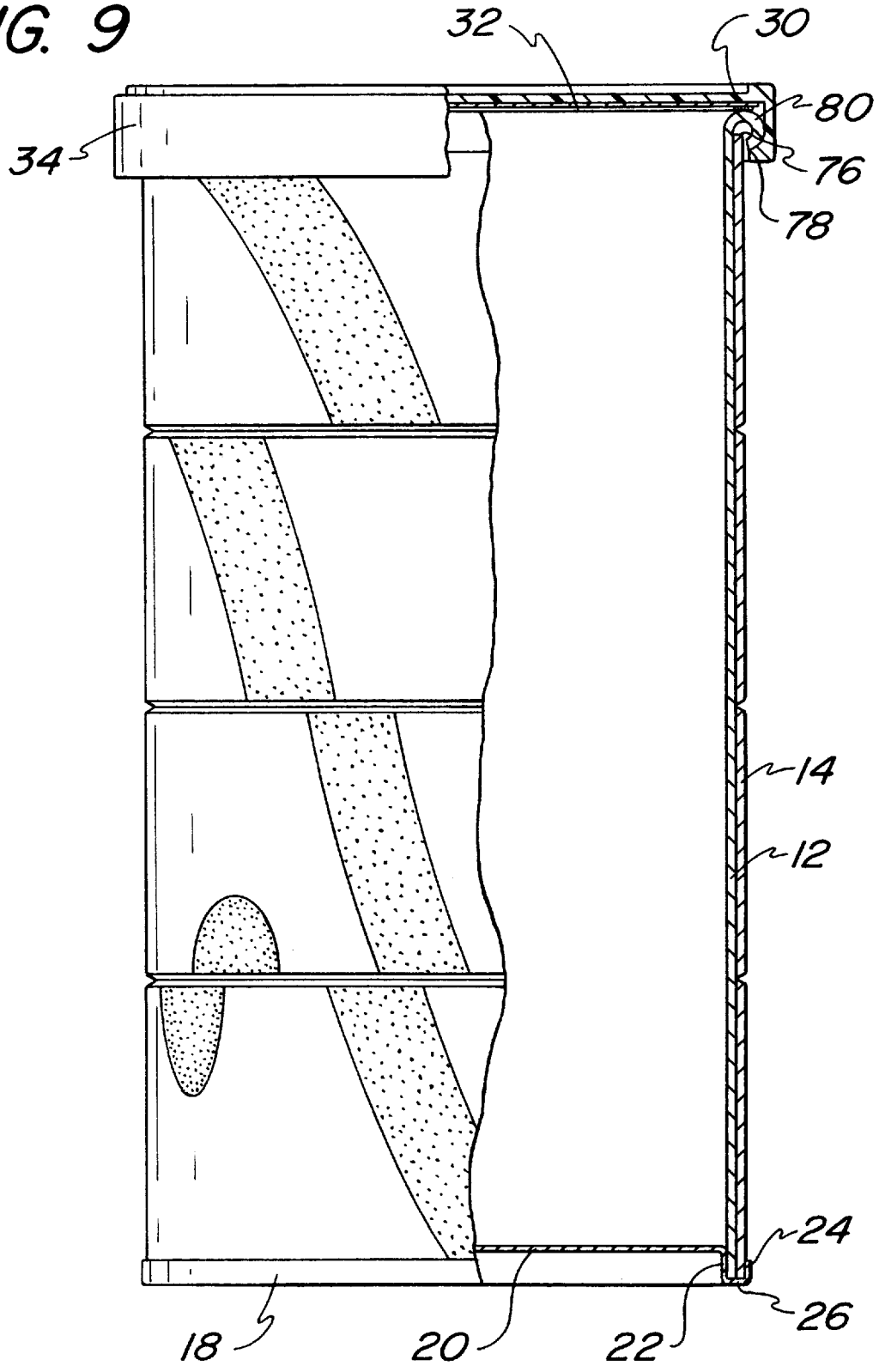
FIG. 9 is a cross-sectional view of a beaded top twist container showing the formation of a top bead after a clearance segment has been removed.
Figure 11:
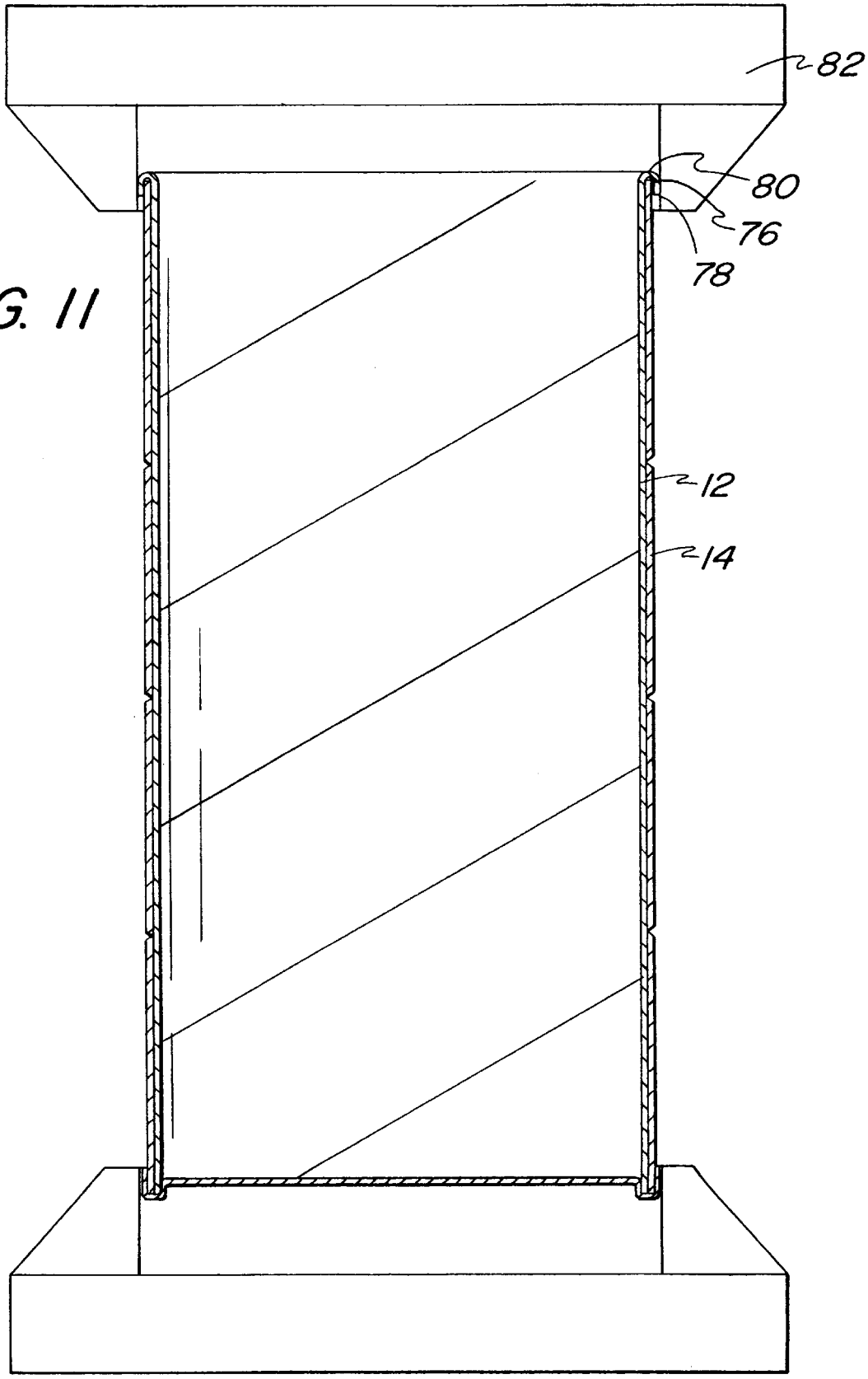
FIG. 11 is a cross-sectional view of a beaded-top twist container showing the formation of a top bead after the outer layer has been separated into rotatable segments.

FIG. 9 shows an alternate embodiment of the beaded-top twist can 10 wherein the top edge 76 of the outer layer 14 is below the top edge 78 of the inner layer 12, and the top edge 78 of the inner layer 12 is rolled outwardly over the outer layer 14. The difference between the top edges 76 and 78 of the inner 12 and outer 14 layers can be created by removing a clearance segment at the top of the outer layer 14 when the inner 12 and outer 14 layers have been originally cut to the same length. FIG. 11 illustrates an assembled inner and outer layer wherein a clearance segment has been already removed. Alternately, when the inner and outer layers are cut to length at separate stages, the lengths can be appropriately cut without requiring a second operation to remove a clearance segment. Once the top edge 76 of the outer layer 14 is sufficiently below the top edge 78 of the inner layer 12, the top bead 30 can be formed by deforming only the inner layer 12. As shown in FIG. 9, the top edge of the inner layer 12 is below the top edge 76 of the outer layer 14. The top edge 78 of the inner layer 12 is rolled outwardly to form a bead 30 to which a top closure 32 can be joined. The inner layer material is rolled over 80 and extends below the top edge 76 of the outer layer 14 as shown. Alternatively, a clearance segment can be removed from the outer layer 14 such that the top edge 76 of the outer layer 14 is below the outwardly rolled inner layer 80.

Figure 10:
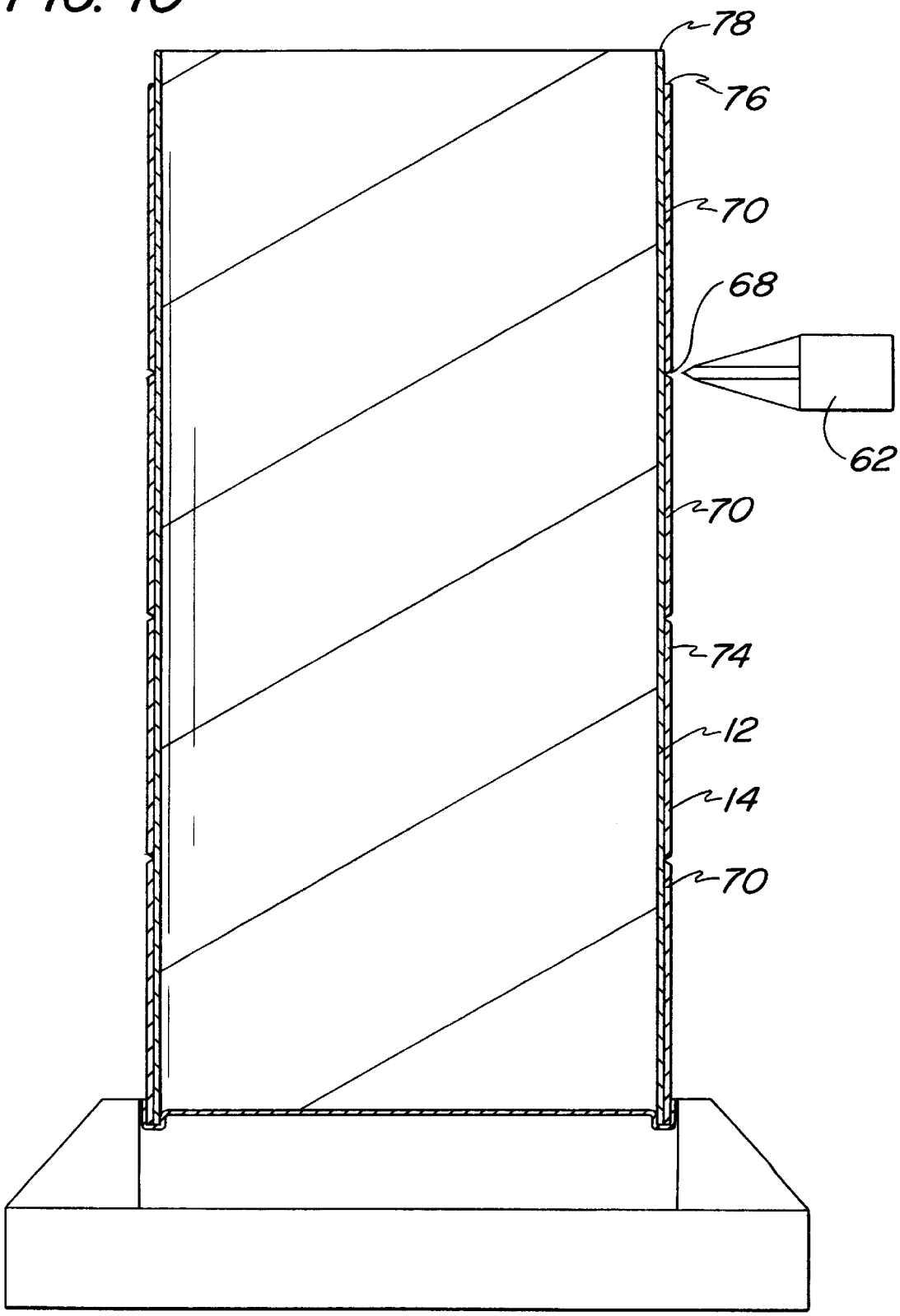
FIG. 10 is a cross-sectional view of a beaded top twist container showing the formation of the rotatable segments prior to formation of a top bead.

FIGS. 10 and 11 show a method for forming a beaded-top twist container wherein a clearance segment is removed prior to the top bead being formed. In FIG. 10, the top edge 76 of the outer layer 14 is below the top edge 78 of the inner layer 12. A scoring tool 62 forms a score line 68 which creates a third rotatable segment 70 in the outer layer. The scoring is accomplished by supporting the beaded-top twist container 10 such that the outer layer 14 cannot twist with the scoring tool 62. FIG. 11 illustrates the formation of an outwardly rolled inner layer 80 by the forcing of a die 82 over the top edge 78 of the inner layer 12, after the rotatable segments 70 have been formed.

Although the preferred method of the invention is to create and remove the clearance segment prior to the formation of additional rotatable segments, it is understood that the clearance segment does not need to be formed and removed first, nor is it required to be located adjacent a top or bottom bead. Also, the clearance segment can be implemented by pre-cutting the inner and outer layers to different lengths, providing an outer layer whose length is reduced by the amount necessary to provide sufficient clearance.

The present invention may be embodied in other specific forms without departing from the spirit or essential attributes thereof and, accordingly, reference should be made to the appended claims, rather than to the foregoing specification, as indicating the scope of the invention.

We claim:

1. A beaded-top twist container comprising:

a cylindrically shaped inner layer, the inner layer having an inside surface, an outside surface and a top and a bottom edge, the inside surface of the inner layer defining an interior volume, the top and bottom edges defining top and bottom openings into the interior volume, the outer surface of the inner layer having an outer diameter;

a cylindrically shaped outer layer concentrically positioned with the inner layer, the outer layer having an inside surface, an outside surface and a top and a bottom edge, the inside surface having an inner diameter, the inside diameter of the outer layer being slightly greater than the outside diameter of the inner layer, the outer layer being separated into at least three segments, the separations comprising score lines through the outer layer around the circumference of the outer layer, each segment having an upper side and a lower side;

a top bead formed around at least the top edge of the inner layer;

the bottom edge of the inner layer and the bottom edge of the outer layer being joined by a bottom joint; and the upper side of a segment being closely adjacent to the top bead.

2. A beaded-top twist container according to claim 1, wherein the top bead is formed by rolling the top edge of the inner layer outwardly over the top edge of the outer layer, the top edge of the outer layer being rotatable around the inner layer.

3. A beaded-top twist container according to claim 2, wherein the bottom joint joining the bottom edge of the inner layer to the bottom edge of the outer layer comprises a metallic closure which spans the bottom opening, the metallic member further having an inner vertical portion and an outer vertical portion and a connecting portion joining the inner and outer vertical portions, the inner, outer, and connecting portions joining the bottom edge of the inner layer to the bottom edge of the outer layer.

4. A beaded-top twist container according to claim 3, further comprising a membrane seal, the membrane seal spanning the top opening and being adhered to the top bead.

5. A beaded-top twist container according to claim 1, wherein the top bead is a bead joint joining the top edge of the inner layer and the top edge of the outer layer by rolling the top edges outwardly.

6. A beaded-top twist container according to claim 5, further comprising a membrane seal, the membrane seal spanning the top opening and being adhered to the bead joint.

7. A beaded-top twist container according to claim 5, wherein the outer layer is separated into at least five segments, at least three of the segments being rotatable, and at least one of said rotatable segments having an upper side adjacent to a bead joint.

8. A beaded-top twist container according to claim 5, wherein the bottom joint joining the bottom edge of the inner layer to the bottom edge of the outer layer comprises a metallic closure which spans the bottom opening, the metallic member further having an inner portion parallel to the inner layer and an outer portion parallel to the outer layer and a connecting portion joining the inner and outer portions, the inner, outer, and connecting portions joining the bottom edge of the inner layer to the bottom edge of the outer layer.

9. A beaded-top twist container according to claim 5, further comprising a membrane seal, the membrane seal spanning the top opening and being adhered to the bead joint joining the top edge of the inner layer and the top edge of the outer layer.

10. A beaded-top twist container according to claim 5, wherein the outer layer is separated into at least five segments, three of the segments being rotatable, at least one of said rotatable segments having an upper side adjacent to a bead joint.

11. A beaded-top twist container comprising:

a cylindrically shaped inner layer, the inner layer having an inside surface, an outside surface and a top and a bottom edge, the outer surface of the inner layer having an outer diameter;

a cylindrically shaped outer layer concentrically positioned with the inner layer, the outer layer having an inside surface, an outside surface and a top and a bottom edge, the inside surface having an inner diameter, the inside diameter of the outer layer being slightly greater than the outside diameter of the inner layer, the outer layer being separated into at least four segments, the separations comprising score lines through the outer layer around the circumference of the outer layer;

the top edge of the inner layer and the top edge of a first said segment of the outer layer being joined by a bead joint;

the bottom edge of the inner layer and the bottom edge of a second said segment of the outer layer being joined by a bead joint; and a bead separation in the outer layer position between the bead joint and one outer layer segment, the bead separation located closely adjacent the bead joint such that no portion of the outer layer between the bead joint and the rotatable segment is visible.

12. A beaded-top twist container comprising:

a cylindrically shaped inner layer, the inner layer having a center axis and an inside surface, the inside surface a constant distance from the center axis, an outside surface and a top and a bottom edge, the outer surface of the inner layer having an outer diameter, the inner layer having a length defined by the distance from the top edge to the bottom edge;

a cylindrically shaped outer layer concentrically positioned with the inner layer, the outer layer having an inside surface, an outside surface and a top and a bottom edge, the inside surface having an inner diameter, the inside diameter of the outer layer being greater than the outside diameter of the inner layer, the outer layer having a length defined by the distance from the top edge to the bottom edge, the outer layer being separated into at least three segments, the separations comprising score lines through the outer layer around the circumference of the outer layer;

the length of the inner layer being greater than the length of the outer layer;

the bottom edge of the inner layer and the bottom edge of a first segment of the outer layer being joined by a bottom closure member; and the top edge of the inner layer being rolled outwardly preventing the segments of the inner layer from moving parallel to the center axis of the inner layer.

13. A method for producing a beaded-top twist container, the method comprising the steps of:

forming a cylindrical shaped inner layer including a top edge and a bottom edge;

forming a cylindrical shaped outer layer, said outer layer concentric with the inner layer and including a top edge and a bottom edge, the top and bottom edges positioned adjacent to the top and bottom edges of the inner layer;

forming a bottom bead joining a bottom closure element to the bottom edges of the inner and outer layers;

forming a top bead along the top edge of at least the inner layer;

forming at least a first rotatable segment by separating the outer layer along at least two circumferential paths which are substantially perpendicular to a long axis of the cylindrically shaped inner layer; said separation dividing the outer layer into at least three segments, at least one segment having an edge adjacent to a bead.

14. A method for producing a beaded-top twist container according to claim 13 wherein the inner layer is formed in long sections which are then cut to length to form the inner layer of the beaded-top twist container.

15. A method for producing a beaded-top twist container according to claim 14 wherein the outer layer is produced by wrapping the outer layer material around a long cylindrical section of inner layer, producing a long section wherein the outer layer and inner layer are assembled, and further comprising the step of cutting the assembled inner and outer layer assembly to length to form a double-walled tube.

16. A method for producing a beaded-top twist container according to claim 13, wherein the top bead is formed by a circumferential top channel, said top channel having a first and second depending leg, the depending legs joined by a base leg, the base leg resting on the top edge of the inner and outer layers, and the first and second depending legs parallel with a portion of the inner and outer layers.

17. A method for producing a beaded-top twist container according to claim 13, wherein the top bead is formed by rolling outwardly the top edge of the inner layer.

18. A method for producing a beaded-top twist container according to claim 13, wherein the top bead is a bead joint formed by rolling outwardly the top edge of the inner and outer layers.

19. A method for producing a beaded-top twist container according to claim 13 further comprising the step of forming a top closure by bonding a membrane to the top bead.

20. A method for producing a beaded-top twist container according to claim 13 further comprising the step of forming a top closure by placing a flexible cap over the top bead.

21. A method for producing a beaded-top twist container according to claim 13 wherein the outer layer is separated into rotatable segments by scoring through the outer layer, said scoring not destroying the integrity of the inner layer; the method further comprising the steps of scoring a relief cut through the outer layer immediately adjacent to a score line used to form a rotatable segment, said relief cut creating a thin ring of outer layer between the relief line and a score line; and removing the thin ring from the beaded-top twist container.

* * * * *